US005964636A

United States Patent [19]

Carrera

[11] Patent Number: 5,964,636

[45] Date of Patent: Oct. 12, 1999

[54] BALLOON TOY

[76] Inventor: Carlos Carrera, 27 Pennroad Ave., Trenton, N.J. 08638

[21] Appl. No.: 09/119,177

[22] Filed: Jul. 20, 1998

[51] Int. Cl.[6] ..... A63H 27/10

[52] U.S. Cl. ..... 446/220

[58] Field of Search ..... 446/220, 221, 446/225, 452, 453

[56] References Cited

U.S. PATENT DOCUMENTS

| | | | |
|---|---|---|---|
| 3,359,678 | 12/1967 | Headrick . | |
| 3,424,405 | 1/1969 | Struble . | |
| 3,509,660 | 5/1970 | Seymour . | |
| 3,612,530 | 10/1971 | Smith . | |
| 3,867,787 | 2/1975 | Weinger . | |
| 4,560,358 | 12/1985 | Adler | 446/46 |
| 4,758,199 | 7/1988 | Tillotson et al. | 446/225 |
| 4,784,628 | 11/1988 | McArdle et al. | 446/225 |
| 4,810,223 | 3/1989 | Stockton | 446/129 |
| 4,944,707 | 7/1990 | Silverglate | 446/48 |
| 5,045,011 | 9/1991 | Lovik | 446/46 |
| 5,078,637 | 1/1992 | McFarland | 446/46 |
| 5,123,869 | 6/1992 | Schipmann | 446/46 |
| 5,261,846 | 11/1993 | Hanna | 446/46 |
| 5,338,243 | 8/1994 | Kieves . | |
| 5,338,244 | 8/1994 | Huang | 446/242 |
| 5,395,276 | 3/1995 | Valentino | 446/217 |
| 5,490,806 | 2/1996 | Spector | 446/48 |
| 5,514,022 | 5/1996 | Harris | 446/75 |
| 5,579,813 | 12/1996 | Watts | 141/317 |
| 5,588,897 | 12/1996 | Valentino | 446/217 |

*Primary Examiner*—John A. Ricci
*Attorney, Agent, or Firm*—William L. Muckelroy, P.C.

[57] ABSTRACT

A floating buoyant toy is made of one or more mylar, metallicized (coated) film, or elastomeric bladders, or closed envelopes, or balloons encompassing a fixed volume of matter that is lighter than the ambient surrounding matter, a like number of spindle and collar combinations or equivalent rotating structures for rotatably engaging each base or aperture of each balloon, each spindle and collar or each equivalent rotating structure being connected to the bottom of a balloon, each collar being adapted to spin around a spindle, and each spindle being connected at each end to a perimetric enclosure and forming a part thereof, the perimetric enclosure forming a circular ring having an inside diameter sufficient to allow each balloon to pass unencumberedly and repeatedly through the ring, one balloon at a time, as the ring is twirled between two aspects, for example, the right and left hands.

16 Claims, 2 Drawing Sheets

BALLOON TOY

TECHNICAL FIELD OF THE INVENTION

The presented novel invention relates generally to toys, and more particularly, to toys that, in combination with one or more balloons, are designed to fly or float through the air with aerodynamic stability such that the toy can be launched, flipped over, maneuvered, and directed towards a target or launched for random slow floatation-like flight or with two balloons attached flip 180 degrees while in a floating position of neutral buoyancy.

BACKGROUND OF THE INVENTION

Gas-filled spheres and bladders have been used in the past to improve the aerodynamic performance of flying objects. For instance, U.S. Pat. No. 303,885 issued to E & H. Ridge on Aug. 19, 1884, discloses a flying target consisting substantially of a flat ring having a center opening in which an inflatable balloon or "bulb" is held. The bulb is manually inflated to give body to the target. Two semicircular wires or bands are pivotally mounted to the ring and are swung outward to a plane that is at a right angle to the surface of the ring and placed closely against the inflated bulb to hold it in position and prevent over-inflation. The bulb is inflated through a tube mounted to the ring that is pinched, preferably by the user's teeth, to seal the bulb. The drawback to Ridge et. al. is that the bulb is retained within the ring by both the inflation tube and the pair of semicircular wires, which adds to the complexity and weight of the target. While target may be suitable for outdoor use on a shooting range, its weight and complexity make it unsuitable for indoor use especially by young children.

U.S. Pat. No. 4,262,911, issued to Opresik et al. Apr. 21, 1981, discloses a "Martian Flyer" comprising a circular wing having a solid generally spherical hollow body in the center. The body is formed of a solid material, such as clear plastic, and is either integrally formed with the wing or is removably attached to the wings using threads, springs, or other fastening means. Because flying game device of Opresik et al. is specifically designed for out-of-doors use, it must be constructed of dense materials that are durable to withstand impact and be less affected by wind. As such, the Opresik et al. "Martian Flyer" is also unsuitable for indoor use. In addition, Opresik et al. contains no teaching or suggestion of using an inflatable balloon, nor is there a teaching or suggestion in Opresik et al. of how to movably mount such a balloon on a disk. Another disadvantage of prior art devices is that they are thin and unable to accommodate spheres or balloons filled with gas that is lighter than air, such as helium. Because the porous nature of the material of these balloons, in particular latex balloons, helium passes readily through the material. Thus, helium-filled latex balloons tend to leak and reduce in size over a period of several hours. As a result, the balloons cannot be retained within the device and will easily fall out or be knocked out. consequently, there is a need in the art for a flying toy that can accommodate an inflatable balloon, and in addition, there is a need in the art for a flying toy can accommodate a helium or other lighter-than-air gas-filled balloon using a mylar envelope which is capable of floating in air.

SUMMARY OF THE INVENTION

The present invention is directed to a flying ball, toy for use with inflatable mylar balloons of the type which have a constricted neck portion terminating at one end in an inflation aperture and at the other end in an imperforate, preferably expandable, side wall. The toy comprises a balloon, aerodynamic body that rotates about a rotational axis when airborne, and holding means for maintaining the balloon in engagement with the aerodynamic body when the balloon is inflated. More particularly, the aerodynamic body has a substantially planar shape and the holding means preferably comprises an opening formed in the body that is sized to fractionally engage the balloon to hold the balloon to the body.

OBJECTS OF THE INVENTION

In accordance with another aspect of the present invention, the opening formed in the body is axially aligned with the rotational axis of the body such that the balloon will be axially aligned with the rotational axis of the body when the balloon is held in the opening. In accordance with yet another aspect of the present novel invention, the balloon is held in the opening to extend outward from both sides of the planar body. In accordance with a further aspect of the present novel invention, a contracting means is provided to hold the balloon in engagement with the body as the balloon contracts, the contracting means comprising the aerodynamic-dynamic body being formed into a first member and a second member, with the first and second members being pivotally attached to each other and biased to move together to contract the opening in response to contraction of the inflatable balloon. In accordance with an alternative embodiment of the present invention, the flying balloon toy comprises an inflatable balloon of the type having a constricted neck portion that terminates at one end in an inflation aperture and at the other end in an imperforate expandable side wall; an aerodynamic body having a V-shaped planar configuration formed of two outwardly projecting wings joined together at a vertex, the aerodynamic body rotating about a rotational axis located at the vertex of the V-shaped planar body when the toy is airborne; and means for holding the balloon in engagement with the aerodynamic body when the balloon is inflated to provide aerodynamic stability to the toy when airborne.

In accordance with another aspect of the present novel invention, the holding means preferably comprises an opening formed in the aerodynamic body that is sized and shaped to frictionally engage the balloon and is axially aligned with the rotational axis of the body such that the balloon is held in the opening to be axially aligned with the rotational axis of the body and to extend outward from both sides of the body.

In accordance with yet another embodiment of the present invention, the Dying balloon toy comprises an inflatable balloon of the type having a constricted neck portion terminating at one end in an inflation aperture and at the other end in an imperforate expandable sidewall; and aerodynamic body having a substantially planar shape with a plurality of wings projecting outward from a central hub, the aerodynamic body having a rotational axis located at the central hub; and holding means for holding the balloon in engagement with the aerodynamic body when the balloon is inflated to provide aerodynamic stability to the toy when airborne.

In accordance with another aspect of the present novel invention, the holding means comprises an opening formed in the hub that is axially aligned with the rotational axis of the body such that the balloon is held in the opening to extend outward from both sides of the planar body in axial alignment with the rotational axis of the planar body. In accordance with yet another embodiment of the present invention, the flying balloon toy comprises an inflatable balloon; an aerodynamic disk-shaped body having a substantially concave lower surface, said body having a rotational axis located at the center point of the disk-shaped body; and means for holding the balloon in engagement with the aerodynamic body when the balloon is inflated.

In accordance with yet another aspect of the present novel invention, the holding means preferably comprises an opening formed in the disk-shaped body that is sized and shaped to frictionally engage the balloon, the opening preferably being axially aligned with the rotation axis of the disk-shaped body such that the balloon held in the opening to extend outward from both sides of the planar body and in axial alignment with the rotational axis of the body.

As will be readily appreciated from the foregoing description, the present invention provides a flying balloon toy that readily accommodates inflatable balloons that are commercially available.

More particularly, the present invention permits an inflatable balloon, both the elastic and mylar types, to be easily and quickly inserted and held within a lightweight flying toy whereby the novel combination makes the toy aerodynamically stable when airborne.

In addition, the present invention increases flight time of the toy by increasing the surface area and drag without increasing weight and complexity. As such, the flying balloon toy formed in accordance with the present invention is ideally suited for indoor use, especially by young children. Furthermore, the present invention also provides a balloon holding structure that contracts or may be sized to accommodate a contraction of the balloon. This is particularly useful with helium and other similar gas-filled balloons that tend to leak at a fairly rapid rate, thus causing contraction in the size the balloon. The holding means of the present invention responds to contraction of the balloon to maintain engagement of the balloon with the aerodynamic body of the novel combinations.

DESCRIPTION OF THE DRAWINGS

That the foregoing and other features and advantages of the present invention are evident upon a prima facie application of the doctrine of equivalents will be appreciated as the novel invention is better understood from the detailed description its novel aspects, as further disclosed herein, when taken in conjunction with the following drawings, wherein.

DETAILED DESCRIPTION OF THE INVENTION

Figure 1:
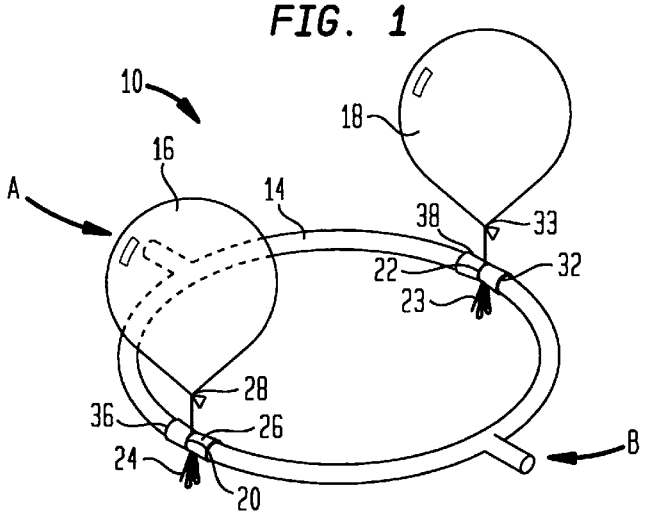
FIG. 1 is a perspective view of a novel combination of a hollow disk and double balloon toy formed and hovering in accordance with one preferred aspect of the present invention wherein the balloons each have equal buoyancy.

FIG. 1 is a perspective view of one of the preferred configurations of a new and novel balloon toy 10. There is shown an apertured perimetric object 14 having a mass $M_1$ suspended in air by a first positive buoyancy means and a second positive buoyancy means. The object 14 is shown as a hoop or ring, for example.

Suitable embodiments of these first and second positive buoyancy means are, for example, balloons 16 and 18. The balloons 16 and 18 and all other balloons described herein are standard state-of-the-art bladders or closed envelopes made of, for example, metalized (coated) plastic film, mylar, flexible plastics, paper, elastomers or their equivalents. The balloons 16 and 18 are each attached to the object 14 opposite each other. The balloon 16 is attached to the object 14 via a first attachment means 20. The balloon 18 is attached to the object 14 via a second attachment means 22. The balloons 16 and 18 are each filled with a lighter than air gas such as, for example, helium.

The first attachment means 20 further comprises a length of string 24, for example, tied to a freely rotating collar 26 and around and above a nozzle 28 which is part of the balloon 16. The string 24 is tied around the nozzle 28 such that the nozzle 28 is closed off and gas inside the balloon 16 is prevented from escaping. As previously stated, the balloons 16 and 18 and all other balloons described herein are standard closed envelopes or bladders made of elastomers, metal foil, mylar, metallicized (coated) plastic or their equivalents.

The second attachment means 22 further comprises a length of string 23, for example, tied to a freely rotating collar 32 and around and above a nozzle 33 which forms an integral part of the balloon 18. The string 23 is tied around the nozzle 33 such that the nozzle 33 is closed off and gas inside the balloon 18 is prevented from escaping. The balloon 18 is attached via the string 23 tying off a nozzle 33 and connecting to the collar 32. Later, it is shown and further described the collar 32 rotates about a shaft means such that the shaft means as part of the object 14 forms a spool means for the collar 32 to rotate about with minimal drag or frictional engagement. To ensure that the collar 32 freely rotates the inventor recommends spraying the collar with a lubricant, for example, WD-40™. Alternative embodiments wherein the string 23 or 24 is tied directly to the object 14 and the collars 26 and 32 omitted, exhibit superior performance with only minimal friction when the string is made of nylon, Teflon, fishing line, or rayon and is coated with the lubricant and wherein the object 14 is made of polyethylene or the like with a U-shaped, indented, cylindrical depression, or V-shaped circumferential groove (not shown in FIG. 1, but see FIGS. 2*a*, 3, 4*a* and 5*b*).

Figure 2A:
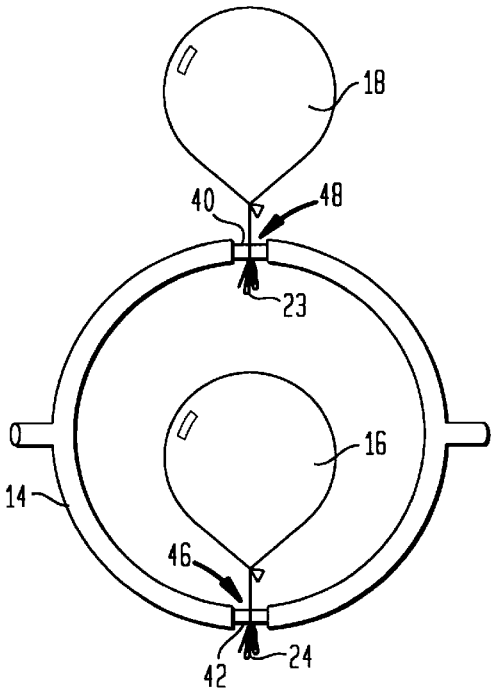
FIG. 2*a* is a front view of the flying balloon toy as shown in FIG. 1 wherein the two balloons have unequal buoyancy.
Figure 2B:
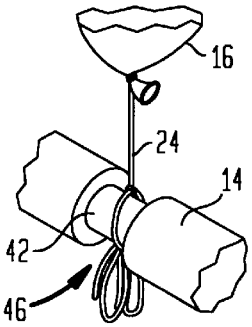
FIG. 2*b* is a close-up perspective view of a first preferred means for attachment of a balloon to the hoop portion of the novel toy.

Referring to FIG. 2*a* there is shown the object 14 depicted with greater detail whereby the collars 26 and 32 shown in FIG. 1 have been removed. The strings 23 and 24 are tied to shafts 40 and 42, respectively. The shafts 40 and 42 form an integral part of the ring 14 such that the ring 14 may be made via injection molding of a single structure. Further details of the ring 14 with the integral shaft 42 are fully illustrated in FIG. 2*b*. The reverse view is the same as shown. There is the balloon 16 shown partially cut away connected via the string 24 tied and knotted to the shaft 42 which is shown as an integral part of the ring 14 (shown partially cut away). Note: The shaft 42 as well as the shaft 40 each have a like diameter and similar shape. The shaft 42 is shown in FIG. 2*b* as forming a U-shaped groove 46. The shaft 40 is shown in FIG. 2*a* as forming a substantially similar U-shaped groove 48 substantially similar to the groove 46.

Figure 2C:
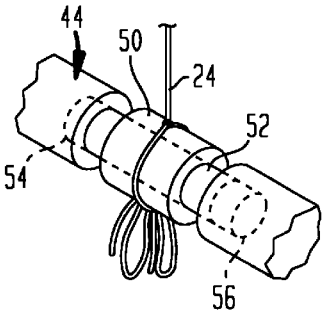
FIG. 2*c* is a close-up perspective view of a second preferred means for attachment of a balloon to the hoop portion of the novel toy.

Shown in FIG. 2*c* is an alternative means for attaching the string 24 (or the string 23, shown in FIG. 2*a*) to a ring, for example ring 44. This alternative means is a collar 50 adapted to freely rotate around a shaft 52. In this embodiment the string 24 is tightly tied to the collar 50. Instead of lubricating the string as previously described, the contacting surfaces of the collar 50 and the shaft 52 are lubricated such that the collar 50 freely rotates about the shaft 52 and whereby the string is secured to the collar 50. In this embodiment the shaft 52 is further modified wherein about 0.5 inches at each end of the shaft 52 are adapted with threading. The shaft 52 is adapted such that it is about 2 inches long and about 0.75 inches in diameter, for example. The ring 44 is adapted such that it is about 18 to 24 inches in circumference and about 1.5 inches in diameter, for example. Unique to this structure is that the ring 44 is adapted with threaded apertures 54 and 56 to receive the threaded ends of the shaft 52 such that when the shaft 52 is screwed into the aperture 54 the threading at the other end is the same such both ends of the shaft 52 are enabled to be screwed into the ring 44 simultaneously. Moreover, the shaft 52 by being adapted in this manner can be attached to the ring 44 without a preferential orientation.

In kit form, the toy is supplied with two half circular pieces to make up the ring 44 with each piece having a threaded recessed aperture similar to apertures 54 and 56 for receiving a separate shaft similar to the shaft 52 (or double ended threaded bolt). Thus, the kit contains two shafts such as shaft 52, two lengths of string, for example 12 inches each, and similar to string 24; and, at least two balloons similar to balloons 16 and 18.

Figure 2D:
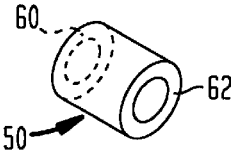
FIG. 2*d* is a close-up perspective view of a first preferred rotating collar for rotatable attachment to a shaft on the hoop portion of the novel toy.

It is critically important that the clearance between the inside diameter of the collar 50, for example, and the outside diameter of the shaft 52, for example, be at least 0.0625 inches and not greater than 0.25 inches for optimal performance of the toy 10 shown in FIG. 1. Moreover, the clearance at each of the sides 60 and 62 of the collar 50 as shown in FIG. 2*d* which forms a space between the ring 44 be at least 0.125 inches and preferably lubricated.

Figure 2E:
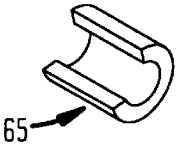
FIG. 2*e* is a close-up perspective view of a second preferred rotating open collar for rotatable attachment via snapping onto a shaft of the hoop portion of the novel toy.

An alternative structure equivalent to the collar 50, which the inventor has found less expensive to manufacture is a split collar 65 as shown in FIG. 2*e*. The split collar 65 is the same as the collar 50 except that a lengthwise longitudinal segment is removed and of a size, 40 degrees, for example, such that the collar 65, made of plastic, is sufficiently flexible such that it can be pushed and clicked over a shaft such as the shafts 40 and 42 shown in FIG. 2*a* and yet maintain the necessary clearance to freely rotate about such a shaft after being flexed and clicked as described. The advantage of the collar 65 is that the ring 14 shown in FIG. 2*a* whether adapted for one or two balloons can be made in one solid piece and the superior lesser friction of the collar and shaft system employed for the novel invention over the cheaper string and groove structure described above and illustrated in detail in FIG. 3.

Figure 3:
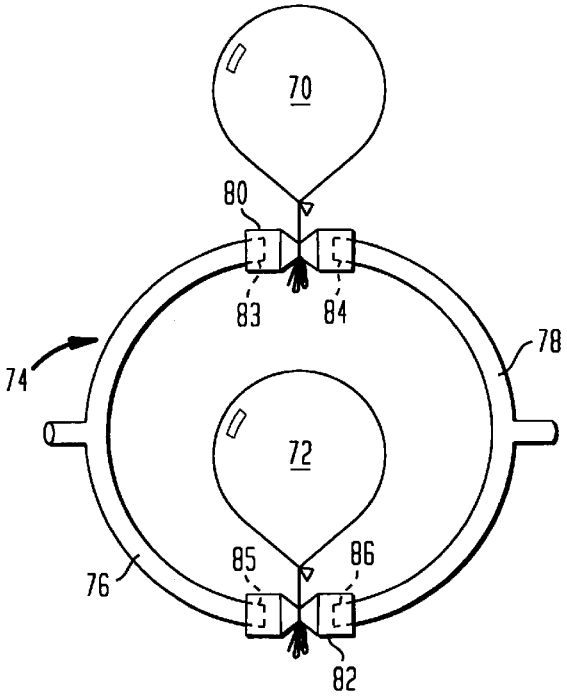
FIG. 3 is a front view of another preferred embodiment of the flying balloon toy wherein the two balloons are attached and have unequal buoyancy.

In FIG. 3 there is shown a pair of like balloons 70 and 72 connected to a ring 74 made of two like one-half hoops 76 and 78. The one-half hoops 76 and 78 are connected at one end via a grooved connecting means, a cylindrical receptacle 80, for example, and at their other end via another grooved connecting means, a cylindrical receptacle 82, for example. The receptacles 80 and 82 each have pairs of apertures 83, 84 and 85, 86, respectively. These apertures are adapted to frictionally engage the ends of the one-half hoops 76 and 78 such that a stable ring 74 is formed.

Figure 4A:
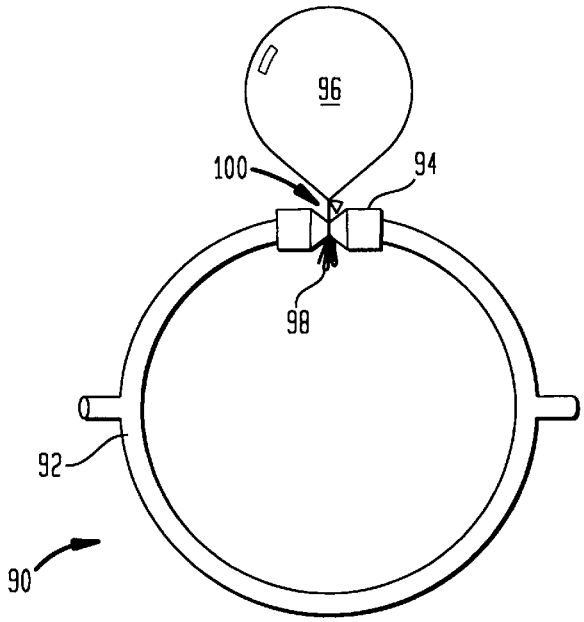
FIG. 4*a* is a perspective view of a novel combination of a hollow disk and a single balloon toy formed and hovering in accordance with one preferred aspect of the present invention wherein the balloon is adapted for positive buoyancy.

Another preferred embodiment of the novel invention is shown as the balloon toy 90 in FIG. 4*a*. There is shown a single integral hoop 92 closed with only one grooved receptacle such as a receptacle 94 structured and functioning the same as the receptacles 80 and 82 shown in FIG. 3. There is further shown a complete balloon toy 90 with a balloon 96 attached via a lubricated string 98 tied loosely about a U-shaped groove 100 in the receptacle 94. The U-shaped groove provides a substantial and unexpected advantage in that the string 98 rotates and slides much more freely than with other groove shapes such as V-shaped, rectangular, inverted trapezoidal, or any kind of angular groove.

Figure 4B:
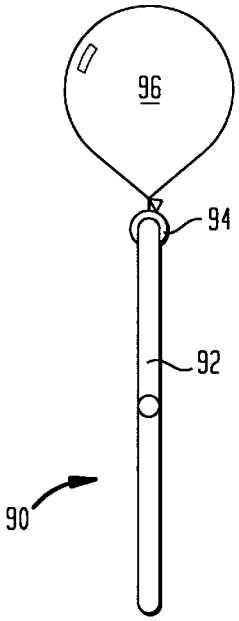
FIG. 4*b* is a partial cross-sectional close-up view of a single balloon toy attached to a slotted shaft of the hoop in accordance with one preferred aspect of the present invention.
Figure 4C:
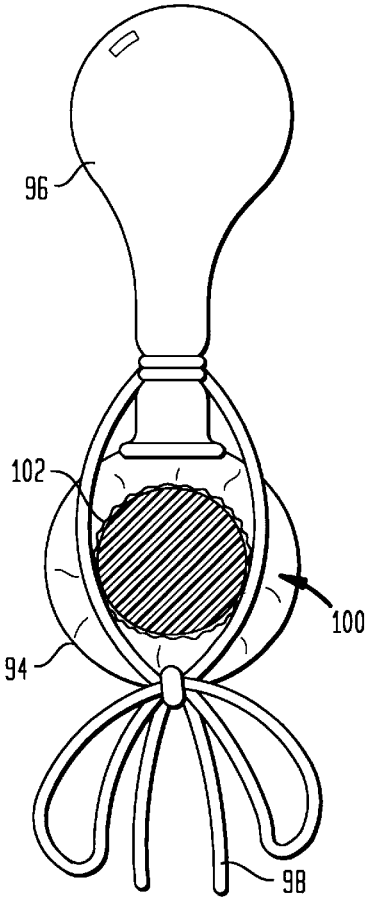
FIG. 4*c* is a close up and partial cross-sectional view of a preferred attachment means and connection means with lubricant.

In FIG. 4*b* there is shown the equivalent of both a left side view and a right side view of the toy 90 shown in FIG. 4*a*. And, there is shown in FIG. 4*c* a close-up and partial cross-section of the receptacle 94 with the string 98 tied around the receptacle 94 inside the groove 100. Shown is a coating 102 comprising a lubricant, WD-40™, which has been applied to the groove 100 to assist the string 98 in easily slipping around and about the receptacle 94. The groove 100 also functions as a means for retaining the string 98 and preventing movement of the string 98 out of the groove 100.

Accordingly, the balloon toy 90 shown in FIGS. 4*a*, 4*b*, and 4*c* functions such that the hoop 92 is capable of being playfully rotated around the balloon 96 filled with lighter-than-air fluid or gas whereby it is buoyant on its vertical axis. This provides previously unimaginable play for children of all ages and adults. Playing with either the novel toy 90 or the novel toy 10 (shown in FIG. 1) provides a new sense of joy through initiation of its mobile component or electing to observe its static component.

The imaginative and novel invention provides an easy way to learn and discover geometrical and general motion concepts like circular, inside, and outside rotation. Moreover, as a teaching tool the terms upper portion, lower portion, buoyancy, 180 degrees of a complete circle of 360 degrees can be easily taught.

The novel toy exhibits vertical up-and-down floating and as rotatably attached to a hoop structure which can be produced in a variety of colors is an enviable novel toy capable of easy and inexpensive mass production in a variety of configurations.

To display publicity on the balloons in stadiums, halls, malls, and other public places, the balloon toy can be constructed in scaled up dimensions, e.g., hoops having a diameter of 6 to 10 feet with concomitant sizes in the balloons and with the finger grasping members omitted.

The hoop 92 shown in FIG. 4A may also be adapted for wind powered rotation about the balloon 96 using a mechanism (not shown) mounted inside the connector 94 and connected to the hoop 92 so as to cause the hoop 92 to rotate slowly around the balloon 96.

The balloon toy 10 shown in FIG. 1 enables novel play by grabbing the hoop 14 at points A and B with both thumb and forefinger or index finger causing the balloon toy 10 to rotate about the imaginary axis connecting A to B.

Figure 5A:
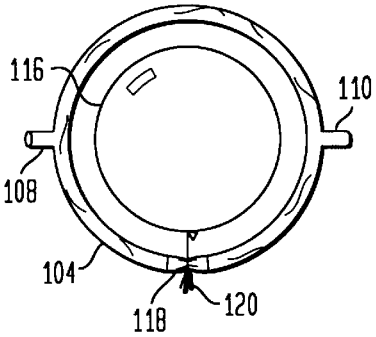
FIG. 5*a* is a front view of a preferred embodiment showing a one balloon version of the novel combination with a grooved engagement means; and, FIG. 5*b* is a front view of a preferred embodiment showing a two balloon version of the novel combination with two grooved engagement means.
Figure 5B:
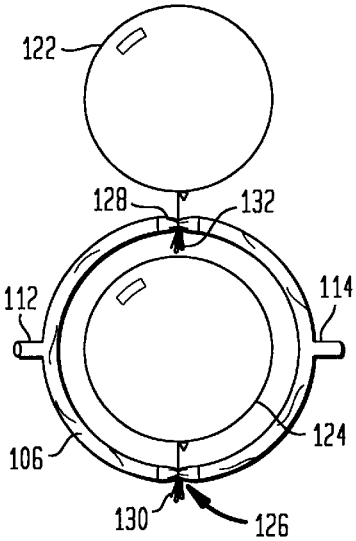

Referring now to FIGS. 5*a* and 5*b*, there is shown in each a unique single piece construction for a loop, the rings 104 and 106, for example, respectively. Each of the rings shown has a pair of twirling extensions, integral posts 108 and 110, for example, and integral posts 112 and 114, for example. A balloon 116 having a diameter such that it clears the inside diameter of the ring 104 is attached to circumferentially disposed groove 118 via a monofilament line 120, for example, such that the line as tied around the groove 118 is caused to rotate as one twirls the ring 104 via twisting the posts 108 and 110 between the thumb and forefinger of one hand and the thumb and forefinger of the other hand. This action creates amusement as the balloon 116 moves through the ring 104 as it is rotated. Similarly, a plurality of two balloons 122 and 124 each having a diameter such that each clears the inside diameter of the ring 106 is attached to separate circumferentially disposed grooves 126 and 128 via monofilament lines 130 and 132, respectively, for example, such that each of the lines 130 and 132 as tied around the grooves 126 and 128 are caused to simultaneously rotate as one twirls the ring 104 via twisting the posts 112 and 114 between the thumb and forefinger of one hand and the thumb and forefinger of the other hand. This action creates amusement as first one balloon then the other move sequentially through the ring 106 as it is rotated through each 360 degrees.

Regarding additional details of the manner of assembly and operation of the balloon toy shown in FIG. 5*a*, firstly, one attaches an airborne, free-floating, lift-weight balanced balloon 116 having an elastomeric nature or a close envelope encompassing a fixed volume of a lighter-than-air fluid, for example helium, to the neck or groove 118. Optionally, a lubricant may be applied to the groove 118. The balloon 116 is attached by an elongated knotable material such as thread, string, or the like, monofilament fishing line 120, for example. Next, holding each of the posts 108 and 110 with a thumb and index finger of the left and right hands, respectively, and then twirling rotatably actuates the ring 104 between the left and right hands. The ring 104 has a horizontal axis which extends through the posts 108 and 110 whereas the groove 118 is intersected by the vertical axis when the balloon 116 is centered within the ring 104.

As the ring 104 rotates on its horizontal axis, balloon 116 moves in a circular motion and up-and-down, simultaneously, while floating with positive buoyancy on its own vertical axis which remains substantially orthogonal through the twirling about the posts 108 and 110.

As shown in FIG. 5*a*, to a child the above-described action when applied to a ring 106 with two similar balloons 122 and 124, but differently patterned or colored, attached to grooves 126 and 128 located opposite each other and transverse to a twirling means such as the pair of posts 112 and 114 appears as a magical display of motion because the balloon 122 appears to sequentially replace the balloon 124. Thus, this ring and buoyant balloon combination is a unique and novel interactive rotational toy.

Within the scope of the novel invention is a scaled up version of the aforementioned balloon and ring assembly and the dual balloon and ring assembly in dimensions wherein each balloon is at least 10 feet in diameter and the larger posts and ring are mounted in a yoke. A mechanism may be attached to one of the posts and rotatably engage same whereby the attention of the public is enhancedly solicited to view signs and marks affixed to the balloons as advertising.

Accordingly, the balloon-hoop toy device of the present invention can be used or played easily and conveniently by persons of almost any age. Furthermore, the balloon-hoop invention has the additional advantages in that:

a) The structural components permit the production of the balloon-hoop toys in separate modular parts or as an integral moldable unit plus the balloon or balloons.

b) The novel structural combination permits the production of the balloon-hoop toys in different sizes for differently sized children.

c) The novel structural combination permits the production of the balloon-hoop in different materials, shapes, and colors.

d) The novel structural combination allows the production of a balloon-hoop connected or associated with its adjacent elements in different materials, shapes, and colors.

e) The novel structural combination provides a balloon-hoop toy as an educational item for teaching motion principles and for teaching different geometrical shapes.

However, from a technical standpoint the invention may be understood in its operation by applying mass and buoyancy principles. For example, the principal invention is a combination of a balloon adapted with a positive buoyancy with respect to ambient with the positive buoyancy being equivalent to a mass $M_1$; a hoop adapted to unemcumberedly and repeatedly encircle said balloon, said hoop having a mass $M_2$; a connection element adapted to rotatably and slippingly engage the hoop at a preselected point thereon and further adapted to attach the balloon to said hoop, said connection element or means having a mass $M_3$; said positive buoyancy exhibited by said balloon and equivalent to a mass $M_1$, being at least equal to the total of the masses $M_2$ and $M_3$. Thus, the balloon causes a combination of the balloon, the hoop, and the connection element to suspendly float in the ambient, for example, in the air. The hoop is adapted to unemcumberedly and repeatedly encircle the balloon. The hoop may be made as a substantially round hollow tube with a circular cross-section and with a wall having a thickness between about 1/20th and about 1/50th the diameter of the circular cross-section of the hoop or tube.

In another version of the novelty buoyant toy is made of a plurality of balloons adapted with a positive buoyancy with respect to ambient air such that the positive buoyancy is equivalent to a mass $M_1$. In this version, the hoop is adapted to sequentially, unemcumberedly and repeatedly encircle the balloons. The hoop is adapted to have a mass $M_2$. An equivalent number of connectors is adapted to rotatably and slipperyly engage the hoop at a preselected point thereon and each connector is further adapted to attach one of the balloons to the hoop, all of the connectors are adapted to exhibit a total mass $M_3$. The positive buoyancy exhibited by all of the balloons and equivalent to a mass $M_1$ is at least equal to the total of the masses $M_2$ and $M_3$. Thus, similar to the one balloon combination, the plurality of balloons, the hoop, and the like plurality of connectors suspendly float in the surrounding ambient air.

In a third aspect, the buoyant balloon toy is made of a bladder filed with a gas, for example helium, or other lighter-than-air substance, such that the bladder is adapted with a positive buoyancy with respect to air. The positive buoyancy being equivalent to a mass $M_1$. The toy has a perimetric structure which forms an aperture having a mass $M_2$ and a first connector attached to the perimetric structure wherein the first connector has a mass $M_3$. The first connector rotatably engages the perimetric structure at a preselected place thereon and has a bladder attached whereas a second connector has another similar bladder attached and is also attached to the perimetric structure. The second connector is adapted to have a mass $M_4$. Thus, again the positive buoyancy causes the combination to float in air, the mass $M_1$ at least equaling the total of the masses $M_2$ plus $M_3$ plus $M_4$.

While the above descriptions of the preferred embodiments contain many exact and specific examples of structures for the novel invention, these should not be construed as limitations on the scope of the invention nor as a abrogation of the applicable doctrine of equivalents. Many other variations exist consistent with the scope of the novel principles exemplified by the novel invention. For example, variations of the circular hoop using a triangle, a square a rectangle, a rhombus, a rhomboid, a trapezoid, a trapezium, a pentagon, a hexagon, a heptagon, an octagon, a nonagon, a decagon, a dodecagon, instead of a circular ring are just a few examples that can either be used with round balloons or balloons mounded to exhibit congruent cross-sections or shapes. As a further example of contemplated variations of the balloon-hoop toy being constructed of a non-circular ring-like component a ring-like closed structure bounded by encircling plane surfaces called polyhedra is also contemplated.

The drawings and the foregoing descriptions represent currently constructed and preferred forms of the invention in regard to the details of its construction and manner of operation. Changes in form and in the proportion of parts as well as the substitution of equivalent materials are contemplated and within the scope of the novel invention except as limited by the following claims, TO WIT:

What is claimed is:

1. A buoyant toy comprising a combination of:

a structure adapted with a positive buoyancy with respect to ambient, said positive buoyancy being equivalent to a mass $M_1$;

a hoop-like means adapted to unencumberedly and repeatedly encircle said structure, said hoop-like means having a mass $M_2$;

a connection means adapted to rotatably and slippingly engage the hoop-like means at a preselected point thereon and further adapted to attach the structure to said hoop-like means, said connection means having a mass $M_3$;

said positive buoyancy exhibited by said structure and equivalent to a mass $M_1$ being at least equal to the total of the masses $M_2$ and $M_3$ whereby the structure causes a combination of the structure, the hoop-like means, and the connection means to suspendly float in the ambient.

2. The buoyant toy according to claim 1 wherein said structure comprises a balloon filled with helium, the balloon having a substantially round shape.

3. The buoyant toy according to claim 2 wherein said hoop-like means adapted to unemcumberedly and repeatedly encircle said structure is a substantially round hollow tube with a circular cross-section and further having a wall with a thickness between about 1/20th and about 1/50th the diameter of the circular cross-section of the tube.

4. The buoyant toy according to claim 1 wherein said structure is a plastic balloon filled with a lighter-than-air gas.

5. The buoyant toy according to claim 1 wherein said structure is sufficiently buoyant to lift said hoop-like means and said connection means attached thereto.

6. The buoyant toy according to claim 1 wherein said structure is a closed envelope made of metallicized plastic film and further wherein said closed envelope is filled with a lighter-than-air gas.

7. The buoyant toy according to claim 1 wherein said aperture means is a hoop.

8. The buoyant toy according to claim 7 wherein said connection means is adapted to rotatably engage said hoop-like means.

9. The buoyant toy according to claim 8 wherein said connection means is string connecting said hoop to said balloon wherein said string is adapted to slippingly engage said hoop-like means, said hoop-like means being a round hollow hoop.

10. The buoyant toy according to claim 9 further comprising a lubricant adapted to coat the string at each point of contact with said hoop.

11. A buoyant balloon toy comprising a combination of:

a plurality of balloons adapted with a positive buoyancy with respect to ambient, said positive buoyancy being equivalent to a mass $M_1$;

a hoop-like means adapted to sequentially, unencumberedly and repeatedly encircle said balloons, said hoop-like means having a mass $M_2$;

a like plurality of connection means adapted to rotatably and slipperyly engage the hoop-like means at a preselected point thereon and each further adapted to attach one of the balloons to said hoop-like means, all of said connection means having a total mass $M_3$;

said positive buoyancy exhibited by all of said balloons and equivalent to a mass $M_1$ being at least equal to the total of the masses $M_2$ and $M_3$ whereby the balloons cause the combination of the plurality of balloons, the hoop-like means, and the like plurality of connection means to suspendly float in the ambient.

12. A buoyant balloon toy comprising the combination of:

a balloon adapted with a positive buoyancy with respect to air, said positive buoyancy being equivalent to a mass $M_1$;

an aperture means forming an aperture having a mass $M_2$;

a first engagement means attached to said aperture means, said first engagement means having a mass $M_3$, said first engagement means rotatably engaging the aperture means at a preselected place thereon;

an attachment means for attaching the balloon to said engagement means, said attachment means having a mass $M_4$;

whereby said positive buoyancy causes the combination to float in air, the mass $M_1$ at least equaling the total of the masses $M_2$ plus $M_3$ plus $M_4$.

13. The buoyant toy according to claim 12 wherein said aperture means is a hoop.

14. The buoyant toy according to claim 13 wherein said first engagement means is made of a cylindrical member rotatably engaging said hoop, and wherein said attachment means is string connecting said hoop to said balloon wherein said string is adapted to slippingly engage said cylindrical member.

15. The buoyant toy according to claim 14 further comprising a lubricant adapted to coat the cylindrical member at each point of contact with said string.

16. The buoyant toy according to claim 15 wherein said string is monofilament plastic fishing line.

* * * * *